US006082982A

United States Patent [19]

Rosser, Jr. et al.

[11] Patent Number: 6,082,982

[45] Date of Patent: Jul. 4, 2000

[54] FLOODED COMPRESSOR WITH IMPROVED OIL RECLAMATION

[75] Inventors: Frank S. Rosser, Jr., La Grange Park; Patrick M. Sugg, Chicago, both of Ill.

[73] Assignee: UOP LLC, Des Plaines, Ill.

[21] Appl. No.: 08/971,633

[22] Filed: Nov. 17, 1997

[51] Int. Cl.[7] ..... F01C 21/04

[52] U.S. Cl. ..... 418/97; 184/6.16

[58] Field of Search ..... 418/87, 97, 55.6, 418/85; 184/6.16

[56] References Cited

U.S. PATENT DOCUMENTS

| | | | |
|---|---|---|---|
| 2,470,655 | 5/1949 | Shaw | 418/85 X |
| 3,191,854 | 6/1965 | Lowler et al. | 418/85 |
| 3,785,755 | 1/1974 | Novak et al. | 418/85 |
| 4,475,876 | 10/1984 | Olen | 418/84 |
| 4,968,231 | 11/1990 | Zimmern et al. | 418/85 X |
| 5,087,178 | 2/1992 | Wells | 418/1 |
| 5,433,590 | 7/1995 | Klaus et al. | 418/85 |

*Primary Examiner*—Hoang Nguyen
*Attorney, Agent, or Firm*—John G. Tolomei

[57] ABSTRACT

Oil reclamation for a flooded screw type compressor is improved by replacing the normal distillation still with a refrigerant vaporizer made from a small diameter pipe conduit and a low temperature heat source such as heat tracing. The system purifies lubricating oil of refrigerant by boiling small batches of collected lubricating oil from the bottom of the chiller. Using a small volume for vaporization of the refrigerant allows a low temperature heat source to effectively vaporize the refrigerant from the circulating lubricating oil without complicated systems for control or pumping. A particular form of the vaporizer is simply a small diameter pipe surrounded by heat tracing tape.

19 Claims, 3 Drawing Sheets

FLOODED COMPRESSOR WITH IMPROVED OIL RECLAMATION

FIELD OF THE INVENTION

This invention relates to the operating circuits of large oil flooded screw compressors and the recovery of circulating oil.

BACKGROUND OF THE INVENTION

Large refrigeration systems for industrial application routinely use oil flooded screw compressors for providing the necessary compression in the refrigeration cycle. Flooded screw compressors are well known and can be used in a wide variety of applications and with a number of different refrigerants. Typical refrigerants include ammonia, Freon and light hydrocarbons.

Circulating lubricating oil from the flooded compressors must be recovered from the effluent of the compressor and recycled to the body of the compressor in a continuous circuit. The design of refrigeration systems using flooded screw compressors is well known as is systems for reclaiming the used lubricating oil for return to the compressor. The majority of the reclaimed oil is taken directly from an oil separator with the small concentrations of the remainder of oil passing with the compressed refrigerant into a chiller. This small portion in the refrigerant is usually in the range of 10 ppm oil and needs to be recovered downstream to prevent the collection of oil in the refrigerant.

Prior art systems typically use an oil still to separate oil from the refrigerant and return the reclaimed oil to the compressor. In typical prior art systems oil is allowed to collect in the bottom of a chiller vessel and is then periodically batched with refrigerant into a still by manual or automatic control. An immersion heater evaporates the refrigerant in the still leaving the oil behind. The oil is transferred from the still and typically returned to the suction line of the compressor. The still operates in a relatively complex fashion and requires a level glass, high and low level switches, automated isolation valves and temperature switches to maintain its operation. Much of this equipment is needed to maintain proper operation of the immersion heater. Once recovered, oil from the still is typically pumped or pressured back to the compressor suction line.

SUMMARY OF THE INVENTION

It is an object of this invention to simplify the equipment for reclaiming oil in flooded screw compressor operations.

It is a further object of this invention to reduce the volume of reclaimed oil that is maintained in an oil reclaimer for a flooded screw compressor.

It is a yet further object of this invention to simplify the return of reclaimed oil from the reclaimer to a flooded screw compressor.

This invention is an oil reclaimer system that uses a low temperature heat source to provide batch vaporization of a low volume of refrigerant and oil recovered from the refrigeration loop of a flooded screw compressor. The combination of controlling the heat source temperature and preferably using a low volume batch of oil and refrigerant in a refrigerant vaporization cycle permits the use of very simple equipment such as small exchanger or a simple conduit and heat tracing to provide the reclaiming of oil and the elimination of a complex still and many of its controls and indicators. Maximum temperature for the heat source will be set below any temperature that would vaporize or cause degradation of the lubricating oil. The low temperature heat source will typically be operated to maintain a maximum skin temperature at any point of less than 160° F. Therefore, in simplified form, the oil reclaimer section can consist of a refrigerant vaporizer in the form of a simple pipe section with heat tracing added around the pipe to heat oil and vaporize refrigerant from the oil for its cyclic reclaiming and return to the compressor. Thus, an arrangement of the invention may use a single pipe to cyclically retain an oil volume for vaporization of the refrigerant. The pipe may be adjusted in length to provide the desired volume.

Another advantage of this invention is the elevation of the oil reclaiming system to provide gravity flow of the reclaimed oil back to the compressor. The gravity transfer of oil from the refrigerant vaporizer further simplifies the equipment by eliminating the need for pressurization of oil in a holding vessel or pumps to return the oil to the inlet of the compressor. The required elevation of the chiller and oil vaporizer may be minimized by keeping the length of the vaporizer pipe short. Where slightly higher volumes of batched oil are desired in the vaporizer, a small manifold system may be used to provide several vertical lengths of small diameter pipe for vaporization of refrigerant and thereby minimize the total length of the vaporizer.

In a further form of this invention, oil from the oil separator may be used to provide the necessary heat for vaporization of refrigerant from the oil after it is withdrawn from the chiller. Oil from the oil separator will usually have sufficient temperature to boil any refrigerant from the oil and refrigerant mixture that enters the vaporizer. The temperature of the oil from the oil separator is also inherently limited by the compressor operation to avoid any overheating of oil.

However the use of the pipe arrangement with heat tracing is preferred, for its simplicity and operational advantages. In the oil still system of the prior art, any problem with the immersion heater or other equipment in the still typically required a shutdown of the refrigeration system. In the system of this invention, any breakdown in the piping of the refrigerant vaporizer or the heat tracing is easily repaired while the system is on-stream. For example, if heat tracing breaks down it is easily replaced without any interference in the operation of the system.

Overall, this invention requires a much lower amount of oil to be kept in the vaporizer than was required in the prior art still. This provides a direct savings in energy that was otherwise wasted in the prior art to maintain a large batch of oil at a high temperature. This invention requires only a very small batch of liquid to be transferred from the chiller. Due to its low volume, any refrigerant transferred with the oil may be readily vaporized with the low temperature heat source such as heat tracing. This replacement of the immersion heater with heat tracing provides significant benefits as discussed.

Additional objects, details and embodiments of this invention are disclosed in the following detailed description of the invention.

DETAILED DESCRIPTION OF THE INVENTION

Figure 1:
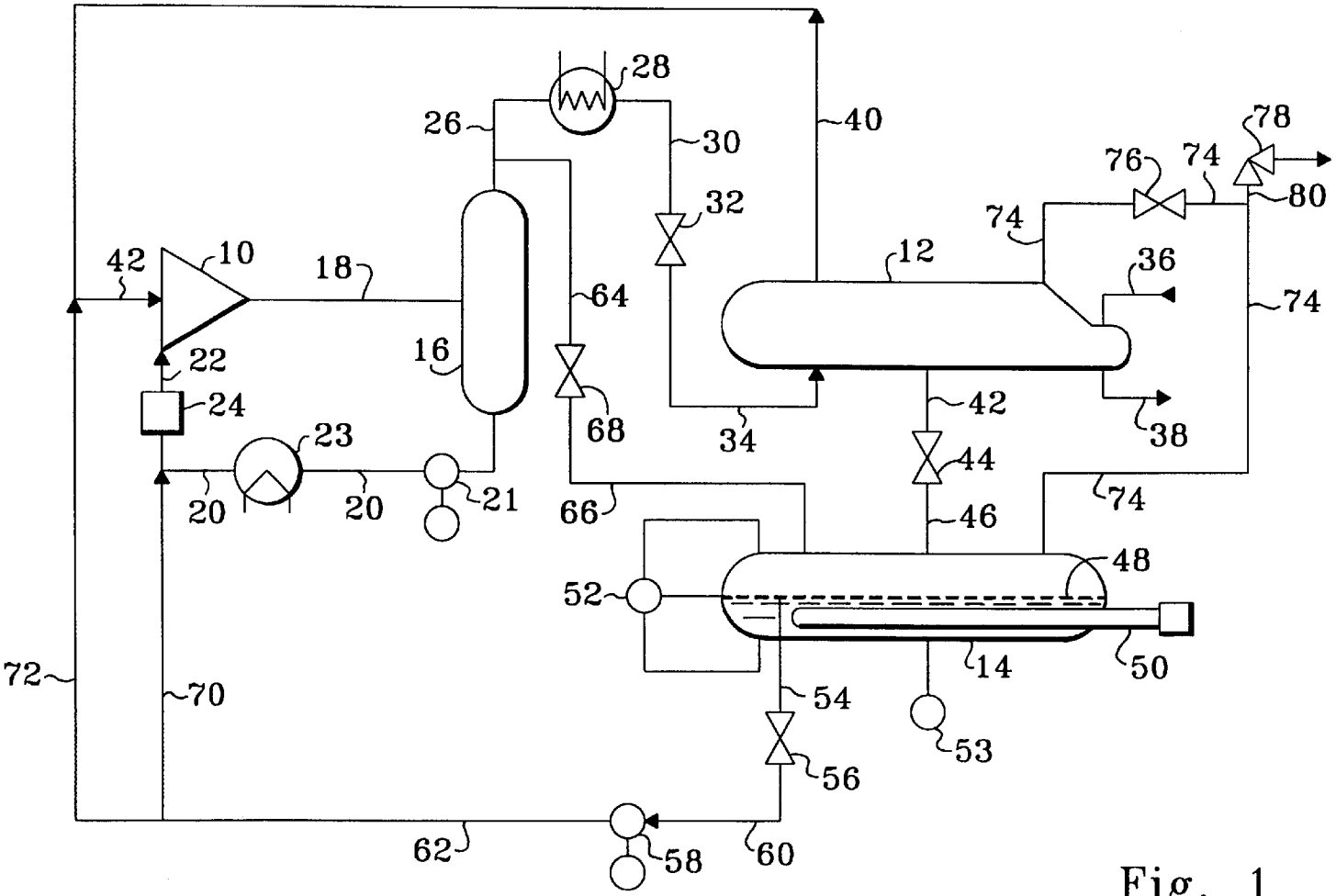
Fig. 1 (PRIOR ART)
FIG. 1 is a schematic diagram of a prior art refrigeration system using an oil still reclaimer.

The advantages and general arrangement of the refrigeration system of this invention can be more fully appreciated by first referring to FIG. 1. FIG. 1 shows a prior art refrigeration system using a flooded screw compressor 10 with an oil separator 16, a chiller 12 and an oil still 14 for reclaiming compressor lubricating oil. In the prior art as well as the system of this invention compressed refrigerant containing oil leaves the compressor discharge through a line 18 and enters oil separator 16. A pump 21 circulates oil recovered from separator 16 to the compressor via lines 20 and 22. Circulating oil passes through a cooler 23 and a filter 24 before returning to the compressor via line 22.

Compressed refrigerant having all but trace amounts of lubricating oil separated therefrom leaves separator 16 via line 26 for transfer to chiller 12. The refrigerant leaving the separator will typically have a concentration of oil in a range of from 10 to 150 ppm. Exchanger 28 cools the compressed refrigerant with an appropriate cooling fluid. A line 30 transfers the cooled compressed refrigerant to an expansion valve 32. A line 34 transfers the cooled refrigerant to chiller 12. Liquid phase refrigerant entering chiller 12 vaporizes within the chiller and a gas phase refrigerant exits the chiller. Chiller 12 provides cooling to a cooled stream that circulates in indirect heat exchange through the chiller via lines 36 and 38. Vapor phase refrigerant from chiller 12 passes out of the top of the chiller via a line 40 for return to the compressor suction line 42.

In the liquid volume of chiller 12 a higher concentration of the residual oil collects in refrigerant or creates a principally oil phase at the bottom of chiller 12. At selected intervals a line 42 withdraws a desired volume from the bottom of chiller 12 when valve 44 is opened. Opening of valve 44 transfers the volume of oil into still 14 via line 46. There is typically no way to determine how much oil has collected at the bottom of chiller 12 and the interval of valve 44 is typically set to a predetermined time period.

Still 14 operates with a liquid level 48 that covers an immersion heater 50. Immersion heater 50 must remain covered with oil at all times to prevent the heater from overheating by operation in a vapor atmosphere. The heater operation is controlled in response to a level indicator 52 that prevents operation of the heater when the low oil level 48 exposes the immersion heater above any liquid. When there is sufficient oil in the still, the immersion heater heats the oil to a sufficient temperature for refrigerant vaporization. Sensing of sufficiently high oil level by instrument 52 and oil temperature by sensor 53 triggers removal of oil from the still via line 54 at a rate regulated by control valve 56. When the level 48 is low, valve 44 is cycled to admit additional liquid from chiller 12. Pipe 54 extends upwardly above the bottom of still 14 to establish a desired level 48. The level 48 however may still drop below the top of line 54 as refrigerant is vaporized and liquid is not replaced at an adequate rate through line 46. Level indicator 52 monitors such a condition and prevents the operation of immersion heater 50 when level is low or alternately when sensor 53 is at or past its set point. Sensor 53 thus also monitors the maximum temperature within the still to prevent overheating of the oil within the still.

The return of oil from still 14 in the prior art is typically performed by pumping it back via line 60, a pump 58 and line 62 to either compressor suction or the oil circulation loop. In lieu of pump 58, a portion of the compressor discharge may be routed via lines 64 and 66 at a rate regulated by control valve 68 to pressurize the oil still and instead drive recovered oil back under pressure through lines 60 and 62. Reclaimed oil is returned either to the circulating lubricating oil loop via a line 70 or to the compressor suction line via a line 72. A line 74 returns vaporized refrigerant to the chiller and can operate under control from a valve 76. For purposes of inspecting the chiller vessel and still, it is typically necessary in such arrangements to provide a relief valve 78 for venting pressurized vapor from the chiller via a line 80 and line 74.

Figure 2:
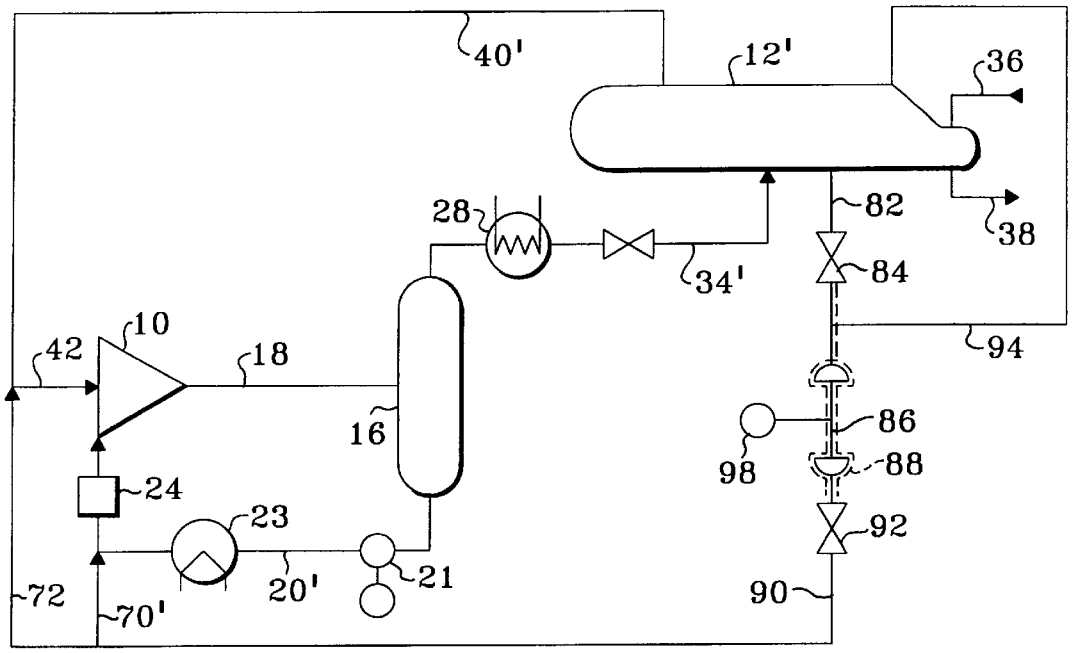
FIG. 2 is a schematic diagram of a refrigeration system using the pipe vaporizer of this invention.

The simplification offered by this invention is readily appreciated from FIG. 2. The basic refrigeration cycle of the compressor 10 and chiller operate in essentially the same manner as that described for FIG. 1. Therefore, where the same reference numerals from FIG. 1 are used in FIG. 2 as well as FIGS. 3 and 4, they are describing essentially the same elements as those referred to in the description of FIG. 1. Looking then to the differences between the two figures, FIG. 2 shows a chiller 12' elevated well above compressor 10 which receives at least partially liquid phase refrigerant from a line 34'. Chiller 12' operates in the manner previously described and returns heated refrigerant to compressor 10 via lines 40' and 42.

A line 82 withdraws liquid containing refrigerant and oil from the bottom of chiller 12' when valve 84 is opened. From valve 84 the liquid flows into a pipe section 86 that is wrapped with heat tracing 88. Vaporized refrigerant from conduit 86 returns to the chiller via an equalizing line 94. When present after vaporization of refrigerant, liquid oil flows from pipe section 86 across an open valve 92 into line 90 for return to line 20 of the circulating lubricating oil via line 70' or to the compressor suction line 42 via a line 72.

Pipe section 86 is referred to as a refrigerant vaporizer since it performs batch vaporization of the liquid refrigerant from the oil that enters therein. A typical cycle begins with valve 92 open so that any liquid oil retained in conduit 86 has drained by gravity back to the compressor. A new liquid withdrawal cycle from chiller 12' begins with the closing of valve 92 and the opening of valve 84 upon verification that valve 92 has closed. Valve 84 is left open for a sufficient time to allow conduit 86 to fill with liquid. At the same time conduit 94 fills to the liquid level in chiller 12'. Pipe 86, is typically relatively short and usually a length of 18 inches or less and more typically a length of about 12 inches. The limited length of the pipe together with a small diameter allow it to retain only a small volume of liquid from the chiller. Since the volumes in conduits 86 and 94 are small, valve 84 will typically have only a 2–3 second delay between opening and closing. After valve 84 has closed heating of liquid in pipe section 86 begin by heat input from heat tracing 88. As the temperature in conduit 86 increases, any refrigerant is heated above its boiling point and returns to chiller 12' via line 94. Valves 84 and 92 remain closed until pipe section 86 has been brought to a sufficient temperature to insure vaporization of any refrigerant contained therein. The heating of the liquid will normally effect an essentially complete removal of refrigerant from the reclaimed oil and reduce the refrigerant in the reclaimed oil to less than 1 ppm. The amount of refrigerant left in the oil will depend in large degree on the type of oil and refrigerant. Usually the oil is a synthetic type that type chosen to be non-miscible with the refrigerant. Temperature is measured by an indicator 98. Once indicator 98 has reached a sufficient temperature, usually about 100 to 160° F. for most light hydrocarbon refrigerants, valve 92 opens to pass any oil back to compressor. After sufficient time, usually about 30 seconds valve 92 closes and the cycle begins again. The entire sequence and opening of the valves can be done on a timed basis or by other control.

Line 90 is preferably arranged to provide free draining of oil back to the compressor or compressor oil circuit. The elevation of the chiller and oil vaporizer is typically established to provide enough liquid head to make gravity return of reclaimed oil possible. This eliminates the need for any circulation pumps for the reclaimed oil.

There may be occasions when the amount of oil is so small that the liquid entering the vaporizer was essentially all refrigerant and virtually no oil flows back when valve 92 opens in the cycle. In order to concentrate the amount of oil withdrawn from the chiller a small boot may be added at its bottom. In most cases an adequate boot would have a diameter of about 2–3 inches and a 4–6 inch length. However, occasionally boiling refrigerant with little oil recovery has little adverse effect on the process since the energy for the heat input from the heat tracing is small.

A high surface to volume ratio yields the most effective use of the heat tracing. High surface area may be provided by keeping the diameter of pipe 86 small usually less than 1–½ inches. The heat tracing used to supply heat to the pipe can be relatively simple. 15–20 watt self regulating electrical heat trace will be sufficient in most cases. The heat tracing may be doubled wrapped to provide additional heat input. For such an arrangement sufficient heating time can be provided with about 30 min. cycles. The size of the vaporizer pipe may be increased by adding fins to the pipe and heat tracing between the fins. With the addition of fins a vaporizer pipe diameters may be increased to a preferred diameter of about three inches. The arrangement of FIG. 2 may also be operated without the return line 94. In such an arrangement, valve 84 again operates on a timed sequence to fill section 86 with oil on controlled basis. In this arrangement, a pressure control valve replaces valve 92. This pressure control valve is preset to maintain the oil in pipe section 26 until vaporization of the refrigerant raises the pressure to a predetermined value. The pressure control vaporization of the refrigerant raises the pressure to a predetermined value. The pressure control valve may be a poppet-like valve that provides pressure relief upon pressure within conduit 86 overcoming a preset spring pressure. Alternately, the pressure control valve could receive a pressure signal that actuates its opening. Vaporization of the refrigerant in conduit 86 to a predetermined pressure provides a driving force to transfer oil back to the compressor without the need for the previously described gravity feed. The regular cycling of valve 84 allows back flow of the gasified refrigerant into the chiller as liquid oil from the chiller displaces its volume during the periodic opening of valve 84. Moreover, although not preferred, valve 84 may operate on level control to open when vaporization of refrigerant drops the liquid level in conduit 86 to a predetermined low limit level.

Figure 3:
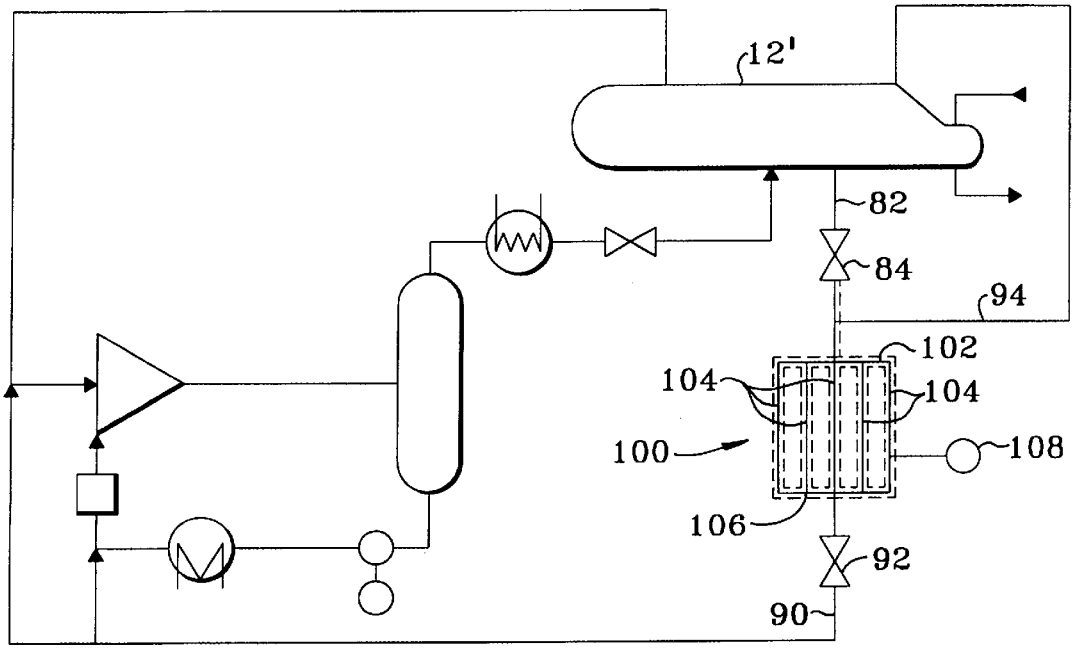
FIG. 3 is a slightly modified system of FIG. 2 using a manifold to provide a number of pipe vaporizers.

FIG. 3 shows an alternate arrangement for the vaporizer of FIG. 2. FIG. 3 shows line 82 again withdrawing liquid from chiller 12' at a rate controlled via control valve 84. The system operates in essentially the same manner as that described for FIG. 2 with reclaimed oil passing back to the compressor through line 90 in a sequence controlled by valves 92 and 84 and vaporized refrigerant again returning to chiller 12' through line 94. In FIG. 3, the single pipe vaporizer having heat tracing is replaced with a multi-pipe manifolded vaporizer 100. Vaporizer 100 has an upper manifold branch 102 that distributes liquid to a series of branches 104 from which liquid is collected by a lower header 106. The entire bundle of tubes 104 may be collectively wrapped with heat tracing to provide the necessary low temperature heat input for vaporization of the refrigerant. Preferably, each pipe branch is individually heat traced to provide rapid heat up of the liquid. Temperature in the pipe branch is again monitored by a temperature sensor 108 that reads the temperature on one or more of the vaporizer pipes. The manifolding arrangement allows a small diameter pipe, typically in the range of 1 to 1½ inches, to again be used to hold a larger volume of liquid from chiller 12' while still permitting low temperature heat tracing to quickly raise the temperature of the liquid to a level necessary to vaporize the refrigerant. Vaporizer 100 can also be provided with suitable disconnects so that a portion of the system may be disassembled while valves 92 and 82 and an optional valve on line 94 isolate the manifold from the rest of system for repair or replacement of pipes or heat tracing.

Figure 4:
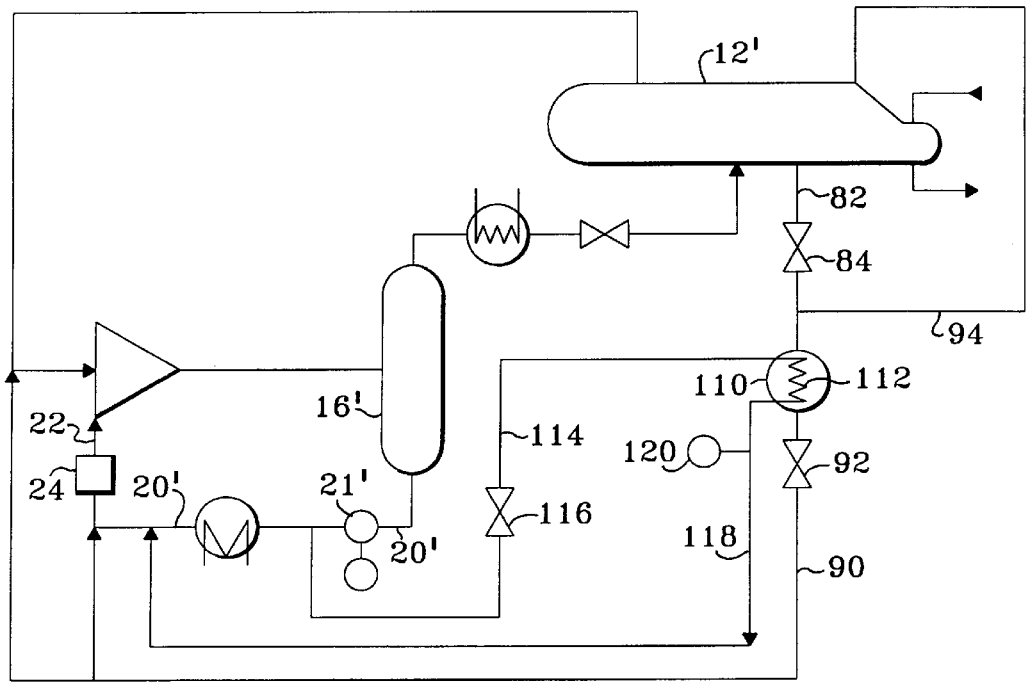
FIG. 4 is a modified schematic diagram using indirect heat exchange with the oil separator to provide heat to the vaporizer.

FIG. 4 shows an alternate method for integrally providing the necessary heat to the vaporizer for the recovery of refrigerant. Again the arrangement in FIG. 4 is, in many respects, the same as that shown in FIG. 3. The major difference is the replacement of the pipe or pipe manifold form of vaporizer with a small, preferably vertical, heat exchanger 110. Exchanger 110 uses oil from an oil separator 16' to supply the heating medium to the vaporizer tubes 112 located in indirect heat exchanger 110. The temperature of the oil from the bottom of the oil separator 16' will usually be in a range of from 100 to 160° F. For most systems there will be a temperature differential of at least 60° F. between liquid withdrawn from the bottom of chiller 12' and oil flowing into exchanger 110 via a line 114. A valve 116 controls the rate of flow of hot oil through exchanger 110. Again, line 82 and valve 84 provide regulated withdrawal of liquid from the bottom of chiller 12' into the shell side of exchanger 110. The vaporization cycle is again further controlled in a similar manner by valve 92 that controls the return of recovered oil to the compressor via line 90. Return of vaporized refrigerant to chiller 12' again proceeds in the same manner previously described through lines 94 as regulated by control valve 96. Hot oil from exchanger 110 returns to the hot oil circuit via a line 118 to any point upstream or downstream of filters 24.

The system operates with either a constant or intermittent circulation of hot oil to exchanger 110. Valves 84 and 92 are again sequenced in the manner previously described to process batches of liquid from chiller 112'. As valve 92 closes and valve 84 opens to deliver a fresh batch of liquid to the shell of exchanger 110, a new cycle begins by the hot oil in tubes 112 heating the shell side oil until all of the refrigerant has been vaporized from the liquid batch. Movement of the batch process through exchanger 110 can be done on a timed basis or by monitoring temperature. Temperature is preferably monitored by sensing the temperature of the hot oil as it exits exchanger 110. Temperature sensor 120 can be programmed to have valve 92 hold liquid in the shell of exchanger 110 until the temperature of the effluent from the exchanger is within a predetermined differential between the normal operating temperature for the recirculating oil. Oil is conveniently passed through the exchanger 110 by withdrawing the oil directly from outlet line 20' downstream of pump 21' and passing it through the tubes of exchanger 110. Line 118 returns the cooled lubricant to line 20' at a point upstream or downstream of filters 24. This arrangement will typically provide enough pressure differential to drive the hot oil at a sufficient velocity through the exchanger for the heating of the vaporization tubes. The return of heat exchange oil to the circulating oil loop is preferably arranged so that line 118 is free draining into line 20' and the return of oil is done by gravity flow.

What is claimed:

1. A system for recovering trace amounts of lubricating oil from the refrigerant in a refrigerant system that uses a flooded screw compressor, said system comprising:

a) a flooded screw compressor for receiving a vaporized refrigerant and compressing the refrigerant to produce a compressed refrigerant having a liquid phase and containing lubricating oil;

b) passing the compressed refrigerant to an oil separator and separating a lubricant oil stream and separated refrigerant stream from said compressed refrigerant and returning said lubricant oil stream to said compressor;

c) passing said compressed refrigerant to a chiller and vaporizing said refrigerant in said chiller to produce said vaporized refrigerant for return to said compressor;

d) collecting a mixture of liquid refrigerant and oil from said chiller and retaining said mixture in a refrigerant vaporizer having a restricted volume and a low temperature indirect heat input that cannot exceed the vaporization temperature of the lubricating oil;

e) heating said mixture in said refrigerant vaporizer until substantially all of the refrigerant has vaporized to produce a reclaimed oil stream; and f) returning the reclaimed oil stream from the vaporizer to the compressor.

2. The system of claim 1 wherein said mixture is recovered from the bottom of said chiller.

3. The system of claim 1 wherein said refrigerant vaporizer comprises a length of pipe having a diameter of less than 3 inches and length of less than 18 inches.

4. The system of claim 1 wherein said low temperature heat input comprises electrical heat tracing tape.

5. The system of claim 1 wherein the maximum temperature of said low temperature heat input does not exceed 140° F.

6. The system of claim 1 wherein said refrigerant vaporizer comprises a multiplicity of vertically oriented pipe having a diameter of less than 2 inches and a length of less than 18 inches.

7. The system of claim 1 wherein said mixture is transferred to said refrigerant vaporizer by opening an inlet valve located upstream of said vaporizer, wherein the reclaimed oil passes out of the vaporizer through an outlet valve, vaporized refrigerant is passed back to said chiller by an equalization line located downstream of said inlet valve, and wherein the inlet valve and outlet valve are cycled such that a batch of the liquid mixture enters the vaporizer while the inlet valve is open and the outlet valve is shut, the mixture is vaporized and returned to the chiller via the equalization line while the inlet and outlet valves are shut, and the outlet valve opens while the inlet valve remains shut to return the reclaimed oil to the compressor once a temperature sensor indicates that the temperature in the vaporizer is sufficient to have vaporized all of the refrigerant.

8. The system of claim 1 wherein the low temperature indirect heat input is supplied by a vertical heat exchanger.

9. The system of claim 8 wherein the vertical heat exchanger heats the liquid mixture by indirect heat exchange with lubricant oil from the oil separator.

10. The system of claim 1 wherein said chiller and vaporizer are elevated above said compressor by a sufficient distance to pass the reclaimed oil stream back to the compressor under gravity flow.

11. The system of claim 1 wherein the vaporization of the refrigerant in the refrigerant vaporizer provides sufficient pressure to pass the reclaimed oil stream back to the compressor.

12. A system for recovering trace amounts of lubricating from the refrigerant in a refrigerant system that uses a flooded screw compressor, said system comprising:

a) a flooded screw compressor for receiving a vaporized refrigerant and compressing the refrigerant to produce a compressed refrigerant having a liquid phase and containing lubricating oil;

b) passing the compressed refrigerant to an oil separator and separating a lubricant oil stream and separated refrigerant stream from said compressed refrigerant and returning said lubricant oil stream to said compressor;

c) passing said compressed refrigerant to a chiller and vaporizing said refrigerant in said chiller to produce said vaporized refrigerant for return to said compressor;

d) collecting a mixture of liquid refrigerant and oil from said chiller and retaining said mixture in a refrigerant vaporizer comprising at least one vertical conduit having a diameter of less than three inches and length of less than 18 inches to produce a restricted volume and heating the restricted volume with heat tracing around the conduit;

e) heating said mixture in said refrigerant vaporizer until substantially all of the refrigerant has vaporized to produce a reclaimed oil stream; and f) returning the reclaimed oil stream from the vaporizer to the compressor.

13. The system of claim 11 wherein said mixture is recovered from the bottom of said chiller.

14. The system of claim 11 wherein said refrigerant vaporizes comprises a multiplicity of vertically oriented pipe having a diameter of less than 2 inches.

15. The system of claim 11 wherein said mixture is transferred to said refrigerant vaporizer by opening an inlet valve located upstream of said vaporizer, wherein the reclaimed oil passes out of the vaporizer through an outlet valve, vaporized refrigerant is passed back to said chiller by an equalization line located downstream of said inlet valve, and wherein the inlet valve and outlet valve are cycled such that a batch of the liquid mixture enters the vaporizer while the inlet valve is open and the outlet valve is shut, the mixture is vaporized and returned to the chiller via the equalization line while the inlet and outlet valves are shut, and the outlet valve opens while the inlet valve remains shut to return the reclaimed oil to the compressor once a temperature sensor indicates that the temperature in the vaporizer is sufficient to have vaporized all of the refrigerant.

16. The system of claim 11 wherein said chiller and vaporizer are elevated above said compressor by a sufficient distance to pass the reclaimed oil stream back to the compressor under gravity flow.

17. The system of claim 16 wherein said mixture is transferred to said refrigerant vaporizer by opening an inlet valve located upstream of said vaporizer, wherein the reclaimed oil passes out of the vaporizer through an outlet valve, vaporized refrigerant is passed back to said chiller by an equalization line located downstream of said inlet valve, and wherein the inlet valve and outlet valve are cycled such that a batch of the liquid mixture enters the vaporizer while the inlet valve is open and the outlet valve is shut, the mixture is vaporized and returned to the chiller via the equalization line while the inlet and outlet valves are shut, and the outlet valve opens while the inlet valve remains shut to return the reclaimed oil to the compressor once a temperature sensor indicates that the temperature of the lubricating oil stream leaving the exchanger is sufficient to have vaporized all of the refrigerant.

18. The system of claim 16 wherein the said heat exchange is carried out in a vertical heat exchanger.

19. The system of claim 16 wherein said chiller and vaporizer are elevated above said compressor by a sufficient distance to pass the reclaimed oil stream back to the compressor under gravity flow.

* * * * *